US011993757B2

(12) United States Patent
Kato

(10) Patent No.: US 11,993,757 B2
(45) Date of Patent: May 28, 2024

(54) LUBRICATING OIL COMPOSITION FOR SHOCK ABSORBER, ADDITIVE FOR FRICTION ADJUSTMENT, LUBRICATING OIL ADDITIVE, SHOCK ABSORBER, AND METHOD FOR ADJUSTING FRICTION OF SHOCK ABSORBER LUBRICATING OIL

(71) Applicant: KYB Corporation, Tokyo (JP)

(72) Inventor: Shinji Kato, Tokyo (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 17/285,175

(22) PCT Filed: Dec. 24, 2019

(86) PCT No.: PCT/IB2019/061323
§ 371 (c)(1),
(2) Date: Apr. 14, 2021

(87) PCT Pub. No.: WO2020/084606
PCT Pub. Date: Apr. 30, 2020

(65) Prior Publication Data

US 2021/0380897 A1 Dec. 9, 2021

(30) Foreign Application Priority Data

Oct. 26, 2018 (JP) ..... 2018-201824

(51) Int. Cl.
*C10M 141/10* (2006.01)
*C10M 169/04* (2006.01)
(Continued)

(52) U.S. Cl.
CPC ..... *C10M 141/10* (2013.01); *C10M 169/04* (2013.01); *C10M 2207/022* (2013.01);
(Continued)

(58) Field of Classification Search
CPC ..... C10M 141/10; C10M 169/04; C10M 2207/022; C10M 2207/283;
(Continued)

(56) References Cited

U.S. PATENT DOCUMENTS 4,466,895 A * 8/1984 Schroeck ..... C10M 137/10 508/368
4,495,075 A * 1/1985 Buckley ..... C10M 141/10 508/291
(Continued)

FOREIGN PATENT DOCUMENTS

JP 2012-224653 A 11/2012
JP 2013-199535 A 10/2013
(Continued)

OTHER PUBLICATIONS

International Search Report dated Mar. 10, 2020, issued in counterpart application No. PCT/IB2019/061323 (2 pages).
(Continued)

*Primary Examiner* — James C Goloboy
(74) *Attorney, Agent, or Firm* — WHDA, LLP

(57) ABSTRACT

To provide a lubricating oil composition for a shock absorber, an additive for friction adjustment, a lubricating oil additive, a shock absorber, and a method for adjusting friction of a shock absorber lubricating oil, capable of achieving both operation stability and riding comfort. A lubricating oil composition for a shock absorber contains a base oil and a friction adjusting agent, in which the friction adjusting agent contains zinc dithiophosphate and pentaerythritol.

5 Claims, 11 Drawing Sheets

(51) Int. Cl.
*C10N 10/04* (2006.01)
*C10N 30/06* (2006.01)
*C10N 40/08* (2006.01)

(52) U.S. Cl.
CPC . *C10M 2207/283* (2013.01); *C10M 2223/045* (2013.01); *C10N 2010/04* (2013.01); *C10N 2030/06* (2013.01); *C10N 2040/08* (2013.01)

(58) Field of Classification Search
CPC ..... C10M 2223/045; C10N 2010/04; C10N 2030/06; C10N 2040/08
See application file for complete search history.

(56) References Cited

U.S. PATENT DOCUMENTS 6,268,316 B1 * 7/2001 Tanaka ..... C10M 171/00 508/293
6,300,293 B1 * 10/2001 Lamberth ..... C10M 137/10 508/436
7,691,792 B1 * 4/2010 Fisher ..... C07C 13/18 508/110
2015/0038384 A1 2/2015 Sakanoue
2015/0184107 A1 7/2015 Sakanoue et al.
2016/0186090 A1 * 6/2016 Sakanoue ..... C10M 161/00 508/206
2016/0194576 A1 7/2016 Sakanoue et al.

FOREIGN PATENT DOCUMENTS

JP 2014-19713 A 2/2014
JP 2018-203953 A 12/2018
JP 2019-019170 A 2/2019
WO 2015/025972 A1 2/2015

OTHER PUBLICATIONS

Nakanishi, "Technical Trends and Tribology of Shock Absorber", Special Issue • Future Vision of Chassis Technology and Tribology, Tribologist, 2009, vol. 54, No. 9, pp. 598-603, cited in Specification, w/ English partial transltaion (8 pages).
Office Action dated Feb. 25, 2022, issued in counterpart CN application No. 201980086336.5, with English Translation. (11 pages).

* cited by examiner

AMPLITUDE INDEX = $\mu 2/\mu 1$

LUBRICATING OIL COMPOSITION FOR SHOCK ABSORBER, ADDITIVE FOR FRICTION ADJUSTMENT, LUBRICATING OIL ADDITIVE, SHOCK ABSORBER, AND METHOD FOR ADJUSTING FRICTION OF SHOCK ABSORBER LUBRICATING OIL

TECHNICAL FIELD

The present invention relates to a lubricating oil composition for a shock absorber, an additive for friction adjustment, a lubricating oil additive, a shock absorber, and a method for adjusting friction of a shock absorber lubricating oil.

BACKGROUND ART

Conventionally, it is known that the vibration damping force of a shock absorber is a combination of a hydraulic damping force generated in a valve and a frictional force generated in a sliding portion between a piston rod and an oil seal or between a piston and a cylinder. It is known that, when the vibration damping force of the shock absorber is high, the driving stability increases but the riding comfort deteriorates, whereas when the vibration damping force of the shock absorber is low, the driving stability deteriorates but the riding comfort is improved. Therefore, in recent years, studies to reduce the frictional force of a shock absorber lubricating oil by adjusting a friction adjusting agent added to the shock absorber lubricating oil have been conducted focusing on the riding comfort (e.g., Non-Patent Literature 1).

PRIOR ART LIST

Patent Literature

[Non-Patent Literature 1] Technical Trends and Tribology of Shock Absorber (Hiroshi NAKANISHI, Tribologist, 2009 (Vol. 54) No. 9, p. 598)

SUMMARY OF THE INVENTION

Problems to be Solved by the Invention

The shock absorber exerts the vibration damping force by a reciprocating motion. However, it takes a certain time for the hydraulic damping force to rise, whereas the frictional force has high responsiveness, and therefore, in a transition from a stationary state to a moving state or at a small amplitude, the frictional force serves as an important factor for the vibration damping force of the shock absorber. However, the prior art does not focus on a difference between the friction characteristics in the transition from a stationary state to a moving state or at a small amplitude and the friction characteristics in a moving state or at a normal amplitude. A conventional shock absorber lubricating oil has had a problem that the riding comfort deteriorates caused by the frictional force in the transition from a stationary state to a moving state or at a small amplitude is different from the frictional force in a moving state or at a normal amplitude.

The present invention provides a lubricating oil composition for a shock absorber, an additive for friction adjustment, a lubricating oil additive, a shock absorber, and a method for adjusting friction of a shock absorber lubricating oil, capable of achieving both operation stability and riding comfort.

Means for Solving the Problems

The present invention is directed to the following lubricating oil compositions for shock absorber (1) to (6).

(1) A lubricating oil composition for a shock absorber containing a base oil and a friction adjusting agent, in which zinc dithiophosphate and pentaerythritol are contained.

(2) In the lubricating oil composition for the shock absorber according to (1) above, the friction adjusting agent is formed so as to adjust the friction coefficient of the composition in the range of 0.02 to 0.05 by combining the pentaerythritol in a proportion of 0.2 wt. % or more based on the total composition with the zinc dithiophosphate.

(3) In the lubricating oil composition for the shock absorber according to (1) or (2) above, the zinc dithiophosphate has at least one secondary alkyl group having 3 to 5 carbon atoms.

(4) In the lubricating oil composition for the shock absorber according to any one of (1) to (3) above, the zinc dithiophosphate is primary zinc dithiophosphate represented by Formula 1 below,

[Chem. 1]

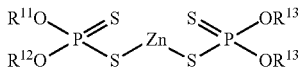

(1)

[in Formula 1, $R^{11}$ to $R^{14}$ each independently represent a primary alkyl group or a secondary alkyl group and at least the primary alkyl group and the secondary alkyl group are different from each other].

(5) In the lubricating oil composition for the shock absorber according to any one of (1) to (4) above, the pentaerythritol contains pentaerythritol tetraester in the largest proportion or in a proportion of 50 wt. % or more.

(6) In the lubricating oil composition for the shock absorber according to any one of (2) to (5) above, the friction adjusting agent is formed so as to adjust the amplitude dependent index in the range of 0.3 to 3.0 in addition to the friction coefficient of the composition.

The present invention is directed to the following additive (7) for friction adjustment of a shock absorber lubricating oil.

(7) An additive for friction adjustment of a shock absorber lubricating oil contains zinc dithiophosphate and pentaerythritol and adjusts the friction coefficient of the shock absorber lubricating oil in the range of 0.02 to 0.05 and the amplitude dependent index in the range of 0.3 to 3.0.

The present invention is directed to the following lubricating oil additives (8) to (11).

(8) A lubricating oil additive contains zinc dithiophosphate and a pentaerythritol ester additive and controls the friction coefficient at a small amplitude of a lubricating oil.

(9) The lubricating oil additive according to (8) above controls the friction coefficient at a small amplitude and the friction coefficient at a normal amplitude of the lubricating oil to substantially the same friction coefficient.

(10) A lubricating oil additive contains zinc dithiophosphate and an ester additive and achieves both improvement and sustainability of riding comfort.

(11) In the lubricating oil additive according to (10) above, the improvement of riding comfort is keeping substantially the same frictional force regardless of the amplitude of a shock absorber.

The present invention is directed to the following shock absorber (10).

(12) A shock absorber contains the lubricating oil composition for the shock absorber according to any one of (1) to (6) above.

The present invention is directed to the following methods for adjusting friction of a lubricating oil (13) to (19) for a shock absorber.

(13) A method for adjusting friction of a lubricating oil composition for a shock absorber includes adding, to the lubricating oil composition for the shock absorber containing a base oil and a friction adjusting agent, a combination of pentaerythritol with zinc dithiophosphate as the friction adjusting agent, in which the friction coefficient of the lubricating oil composition for the shock absorber is adjusted in the range of 0.02 to 0.05.

(14) The method for adjusting friction of a shock absorber lubricating oil according to (13) above includes adding the friction adjusting agent formed so as to adjust the friction coefficient of the composition in the range of 0.02 to 0.05 by combining the pentaerythritol in a proportion of 0.2 wt. % or more based on the total composition with the zinc dithiophosphate.

(15) In the method for adjusting friction of a shock absorber lubricating oil according to (13) or (14) above, the adjustment period is a fixed period.

(16) In the method for adjusting friction of a shock absorber lubricating oil according to any one of (13) to (15) above, the zinc dithiophosphate has at least one secondary alkyl group having 3 to 5 carbon atoms.

(17) In the method for adjusting friction of a shock absorber lubricating oil according to any one of (13) to (16) above, the zinc dithiophosphate is primary zinc dithiophosphate represented by Formula 1 below,

[Chem. 2]

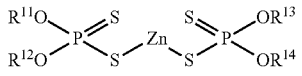

(1)

[in Formula 1, $R^{11}$ to $R^{14}$ each independently represent a primary alkyl group or a secondary alkyl group and at least the primary alkyl group and the secondary alkyl group are different from each other].

(18) In the method for adjusting friction of a shock absorber lubricating oil according to any one of (13) to (17) above, the pentaerythritol contains pentaerythritol tetraester in the largest proportion or in a proportion of 50 wt. % or more.

(19) In the method for adjusting friction of a shock absorber lubricating oil according to any one of (14) to (18) above, the friction adjusting agent to be added is formed so as to adjust the amplitude dependent index in the range of 0.3 to 3.0 in addition to the friction coefficient of the composition.

Effects of Invention

A lubricating oil composition for a shock absorber, an additive for friction adjustment, a lubricating oil additive, a shock absorber, and a method for adjusting friction of a shock absorber lubricating oil, capable of achieving both operation stability and riding comfort can be provided.

DESCRIPTION OF EMBODIMENTS

Figure 1:
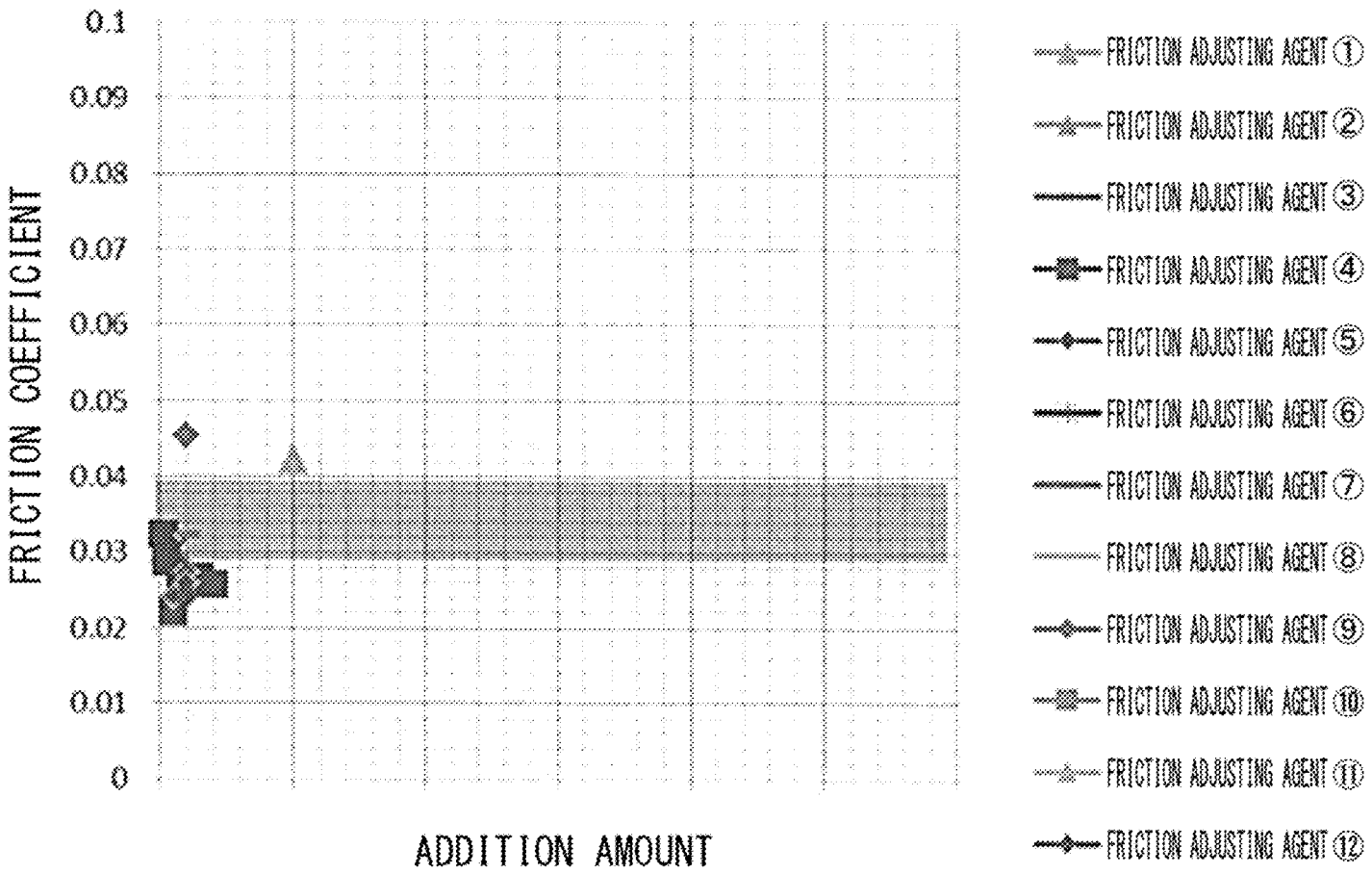
FIG. 1 is a graph illustrating the relationship between the friction coefficient of a shock absorber lubricating oil to which no ZnDTP is added and the addition amount of various friction adjusting agents.

Hereinafter, a lubricating oil composition for a shock absorber, an additive for friction adjustment, a lubricating oil additive, a shock absorber, and a method for adjusting friction of a shock absorber lubricating oil according to the present invention are described based on the drawings. In the following embodiments, the embodiments of the lubricating oil composition for the shock absorber according to the present invention are described by taking a shock absorber lubricating oil as an example.

A shock absorber lubricating oil according to this embodiment has (A) a base oil and (B) zinc dithiophosphate (hereinafter, also referred to as ZnDTP) as a friction adjusting agent, in which (B) the friction adjusting agent contains a combination of (B2) pentaerythritol with (B1) ZnDTP. Particularly in the shock absorber lubricating oil according to this embodiment, with ZnDTP which has been conventionally used to be added, the addition of pentaerythritol as the friction adjusting agent to the lubricating oil can easily achieve the adjustment to a friction coefficient suitable for riding comfort and driving stability, a reduction in a difference between the friction coefficient in a transition from a stationary state to a moving state or at a small amplitude and the friction coefficient in a moving state or at a normal amplitude, and an improvement of the riding comfort. Further, in the shock absorber lubricating oil according to this embodiment, the addition of the pentaerythritol in addition to the ZnDTP enables the suppression of the ZnDTP deterioration (decomposition) by the pentaerythritol. Therefore, a shock absorber lubricating oil and an additive for friction adjustment of a shock absorber capable of sustainably achieving both riding comfort and driving stability over a long period of time can be provided.

(A) Base Oil

The base oil in the shock absorber lubricating oil according to this embodiment is a mineral oil and/or a synthetic oil. The type of the mineral oil or the synthetic oil is not particularly limited. Examples of the mineral oils include paraffinic mineral oil, intermediate base mineral oil, naphthenic mineral oil, and the like obtained by common refining methods, such as solvent refining and hydrogenation refining. Examples of the synthetic oils include polybutene, polyolefin (α-olefin (co)polymers), various esters (e.g., polyol esters, dibasic acid esters, phosphoric acid esters, and the like), various ethers (e.g., polyphenyl ethers and the like), alkylbenzene, alkylnaphthalene, and the like.

In the present invention, the mineral oils above may be used alone or in combination of two or more kinds thereof as the base oil. The synthetic oils above may be used alone or in combination of two or more kinds thereof. Further, one or more mineral oils and one or more synthetic oils may be used in combination.

(B) Friction Adjusting Agent

Conventional hydraulic oils have adjusted the friction with a combination of friction adjusting agents of a phosphorus type, an amine type, an ester type, and the like. The appropriate addition amount of each of the friction adjusting agents varies depending on the balance with the other additives contained therein and cannot be uniformly determined. The friction adjusting agents are contained in a proportion of 0.3 to 2.0 wt. % based on the total amount of the composition and are usually contained in a very small amount of 0.5 wt. % or less. The friction adjusting agents are combined for friction adjustment. Therefore, the use of various additives (e.g., friction adjusting agents) for the shock absorber lubricating oil greatly change the characteristics, which has posed a problem of friction between parts due to increased friction, for example, in addition to riding comfort performance.

The ZnDTP has been used from the 1930s and its effect is empirically known. However, the action mechanism and the behavior in the presence of other additives have not been sufficiently elucidated, and future studies have been expected. The present inventor has recognized problems that the use of ZnDTP, which is a phosphorus-based friction adjusting agent, among the conventional friction adjusting agents, increases the friction, and thus the friction adjustment range by the various additives is expanded and the use of the ZnDTP, which can improve the feel of the riding comfort, changes the friction due to the progress of use, thus it makes difficult to stabilize the riding comfort performance and the quality. In order to solve such problems, the present inventor has invented a method that achieves both the riding comfort performance and durability by using pentaerythritol, which is an additive having specific friction characteristics suitable for the riding comfort and having friction characteristics saturated to the addition amount.

As the friction adjusting agent, a combination of pentaerythritol in a proportion of 0.2 wt. % or more based on the total lubricating oil composition with conventionally used zinc dithiophosphate is mentioned. The friction characteristics are saturated with the 0.2 wt. % of pentaerythritol and the riding comfort performance can be obtained. With respect to the durability performance, the addition of the 2.0 wt. % of pentaerythritol can give good results that both the durability and the riding comfort performance are achieved.

A description is given based on the above-described findings.

The shock absorber lubricating oil according to this embodiment contains the friction adjusting agent. The friction adjusting agent is not particularly limited and can contain various antifriction agents of a phosphorus type, an amine type, an ester type, and the like. The antifriction agents are various lubricants containing one or two or more kinds of such materials or one or two or more kinds of various materials capable of changing the friction coefficient of a surface lubricated by a fluid. By adjusting the addition amount of the antifriction agent, the friction coefficient of the shock absorber lubricating oil can be adjusted.

The friction adjusting agent according to this embodiment further contains (B1) zinc dithiophosphate and (B2) pentaerythritol as described below.

(B1) Zinc Dithiophosphate (ZnDTP)

The ZnDTP is represented by General Formula 3 below and has a function of assisting the adjustment of the friction coefficient by the friction adjusting agent. Rs in General Formula 3 below each independently represent a hydrocarbon group. Examples thereof include linear primary alkyl groups, branched secondary alkyl groups, or aryl groups. In this embodiment, Rs are not particularly limited and preferably have at least one or more short chain (3 to 5 carbon atoms) secondary alkyl groups.

[Chem. 3]

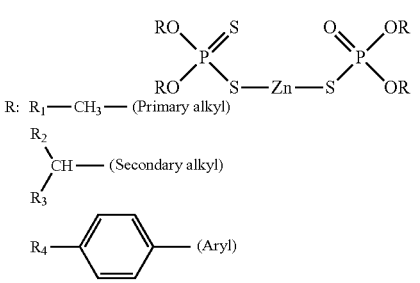

(3)

The ZnDTP according to this embodiment preferably has at least a secondary alkyl group and preferably has a larger number of secondary alkyl groups than the number of the primary alkyl groups. In this embodiment, different types of ZnDTP can be mixed. However, in this case, ZnDTP having at least a secondary alkyl group is preferably contained. The ZnDTP as a whole preferably has a larger number of the secondary alkyl groups than the number of the primary alkyl groups. The alkyl group preferably has a short chain rather than a long chain. Therefore, the ZnDTP according to this embodiment has at least a short chain (3 to 5 carbon atoms) secondary alkyl group. A method for measuring the alkyl group of the ZnDTP is not particularly limited. For example, it can be measured whether the alkyl group is a primary alkyl group or a secondary alkyl group or has a short chain or a long chain based on the characteristics of the absorption band of P—O—C and the absorption bands of P═S, P—S using the FT-IR fingerprint region.

Figure 2:
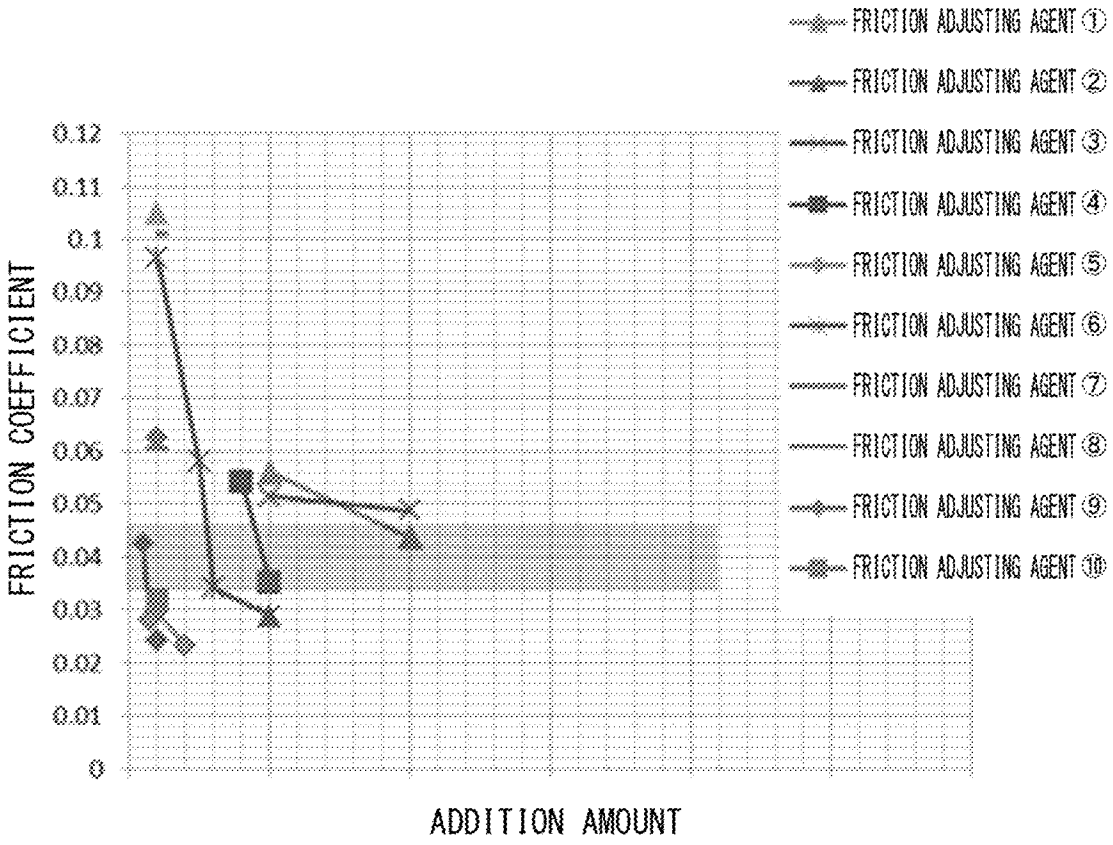
FIG. 2 is a graph illustrating the relationship between the friction coefficient of a shock absorber lubricating oil to which ZnDTP is added and the addition amount of various friction adjusting agents.

FIG. 1 is a view illustrating the relationship between the friction coefficient of the shock absorber lubricating oil and the addition amount of each friction adjusting agent. FIG. 1 illustrates the friction coefficients of shock absorber lubricating oils to which no ZnDTP is added. FIG. 2 illustrates the friction coefficients of shock absorber lubricating oils to which ZnDTP is added. When the friction coefficient of the shock absorber lubricating oil is excessively small, the driving stability deteriorates. When the friction coefficient of the shock absorber lubricating oil is excessively large, the riding comfort deteriorates. Therefore, the friction coefficient is preferably adjusted in the range of 0.02 to 0.05. Conventionally, the friction coefficient has been adjusted by adjusting the addition amount of the friction adjusting agent. However, when no ZnDTP is added as illustrated in FIG. 1, it is difficult to adjust the friction coefficient with the friction adjusting agent alone. In contrast, when ZnDTP is added as illustrated in FIG. 2, it becomes easy to adjust the friction coefficient according to the addition amount of the friction adjusting agent, and the friction coefficient can be adjusted in the target range of 0.02 to 0.05. In the examples illustrated in FIGS. 1 and 2, the friction coefficient was measured by a reciprocating friction test in which a rubber test piece is reciprocated while being pressed against a chrome-plated test piece at a load of 20 N.

As described above, the ZnDTP is not particularly limited and commercially available items or those obtained by conventionally known manufacturing methods are usable. The ZnDTP can be used in only one kind or in combination of two or more kinds. Action mechanism of ZnDTP has not been sufficiently elucidated, however the present inventors have studied the structure of ZnDTP suitable for improving the riding comfort. Then, the present inventors have found that chemical mix (a technique of first mixing alcohol, and then manufacturing ZnDTP) of secondary carbon chain C3 or secondary carbon chain C4 and primary carbon chain C8 exerts effects for improving the riding comfort, but physical mix of mixing manufactured ZnDTP with a single structure later does not obtain sufficient performance. Regarding to these findings, a patent application (JP 2019-085919 A) have been already filed.

More specifically, as the ZnDTP of the present invention, ZnDTP represented by Formula 1 below can be combined with pentaerythritol to form a friction adjusting agent for adjusting the friction coefficient of the shock absorber lubricating oil in the range of 0.02 to 0.05. More specifically, preferable specific examples as the ZnDTP are as follows.

[Chem. 4]

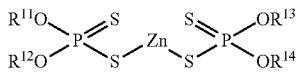

(1)

[In Formula 1, $R^{11}$ to $R^{14}$ are alkyl groups, and the alkyl groups have a primary alkyl group and a secondary alkyl group. More specifically, one or more and three or less Rs of $R^{11}$ to $R^{14}$ are primary alkyl groups and the rest of $R^{11}$ to $R^{14}$ are secondary alkyl groups.]

In the ZnDTP of Formula 1, examples of the primary alkyl groups include, but are not particularly limited to, a methyl group, an ethyl group, an n-propyl group, an n-butyl group, an n-pentyl group, an n-hexyl group, an n-heptyl group, an n-octyl group, an n-nonyl group, an n-decyl group, an isoamyl group, an isobutyl group, a 2-methylbutyl group, a 2-ethylhexyl group, a 2,3-dimethylbutyl group, a 2-methylpentyl group, and the like, for example. The primary alkyl groups are preferably alkyl groups having 4 to 12 carbon atoms (e.g., an isobutyl group (4 carbon atoms) or a 2-ethylhexyl group (8 carbon atoms)).

In the ZnDTP of Formula 1, examples of the secondary alkyl groups include, but are not particularly limited to, an isopropyl group, a sec-butyl group, a 1-ethylpropyl group, a 4-methyl-2-pentyl group, and the like, for example. The secondary alkyl groups are preferably alkyl groups having 3 to 6 carbon atoms (e.g., an isopropyl group (3 carbon atoms)).

In the ZnDTP of Formula 1, the ratio between the primary alkyl group and the secondary alkyl group is not particularly limited and the primary alkyl group ratio is preferably higher than the secondary alkyl group ratio.

The content of the ZnDTP of Formula 1 is not particularly limited and is preferably 0.1 wt. % or more and more preferably 0.25 wt. % or more in the shock absorber lubricating oil. The content of the ZnDTP of Formula 1 is preferably set to 4.0 wt. % or less and more preferably 2.0 wt. % or less in the shock absorber lubricating oil.

The shock absorber lubricating oil according to this embodiment has, as the friction adjusting agent, ZnDTP of Formula 2 having a structure different from that of the ZnDTP of Formula 1. The ZnDTP of Formula 2 is represented by Chem. 5.

[Chem. 5]

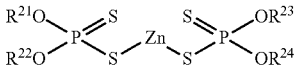

(2)

[In Formula 2, $R^{21}$ to $R^{24}$ are secondary alkyl groups. More specifically, the ZnDTP of Formula 2 has no primary alkyl groups and has only secondary alkyl groups.]

The number of carbon atoms of the secondary alkyl groups contained in ZnDTP of Formula 2 is not particularly limited. For example, an isopropyl group, a sec-butyl group, a 1-ethylpropyl group, a 2-ethylhexyl group, a 4-methyl-2-pentyl group, and the like are mentioned. The secondary alkyl groups are preferable alkyl groups having 3 to 8 carbon atoms (e.g., an isopropyl group (3 carbon atoms), a 2-ethylhexyl group (8 carbon atoms), an isobutyl group (4 carbon atoms), or the like).

The content of the ZnDTP of Formula 2 is not particularly limited and is preferably smaller than that of the ZnDTP of Formula 1 and is preferably 20 wt. % or less based on the ZnDTP addition amount (total amount of the ZnDTP of Formula 1 and the ZnDTP of Formula 2).

The type of the alkyl groups contained in the ZnDTP can be measured by a known measuring method. For example, the structure of the ZnDTP can be determined using C13-NMR or the structure of the ZnDTP can be determined by analyzing whether the alkyl group is a primary alkyl group or a secondary alkyl group from the characteristics of the absorption band of P—O—C and the absorption bands of P═S, P—S using the fingerprint region of FT-IR.

[Friction Test 1] Effect of ZnDTP Addition

Figure 5:
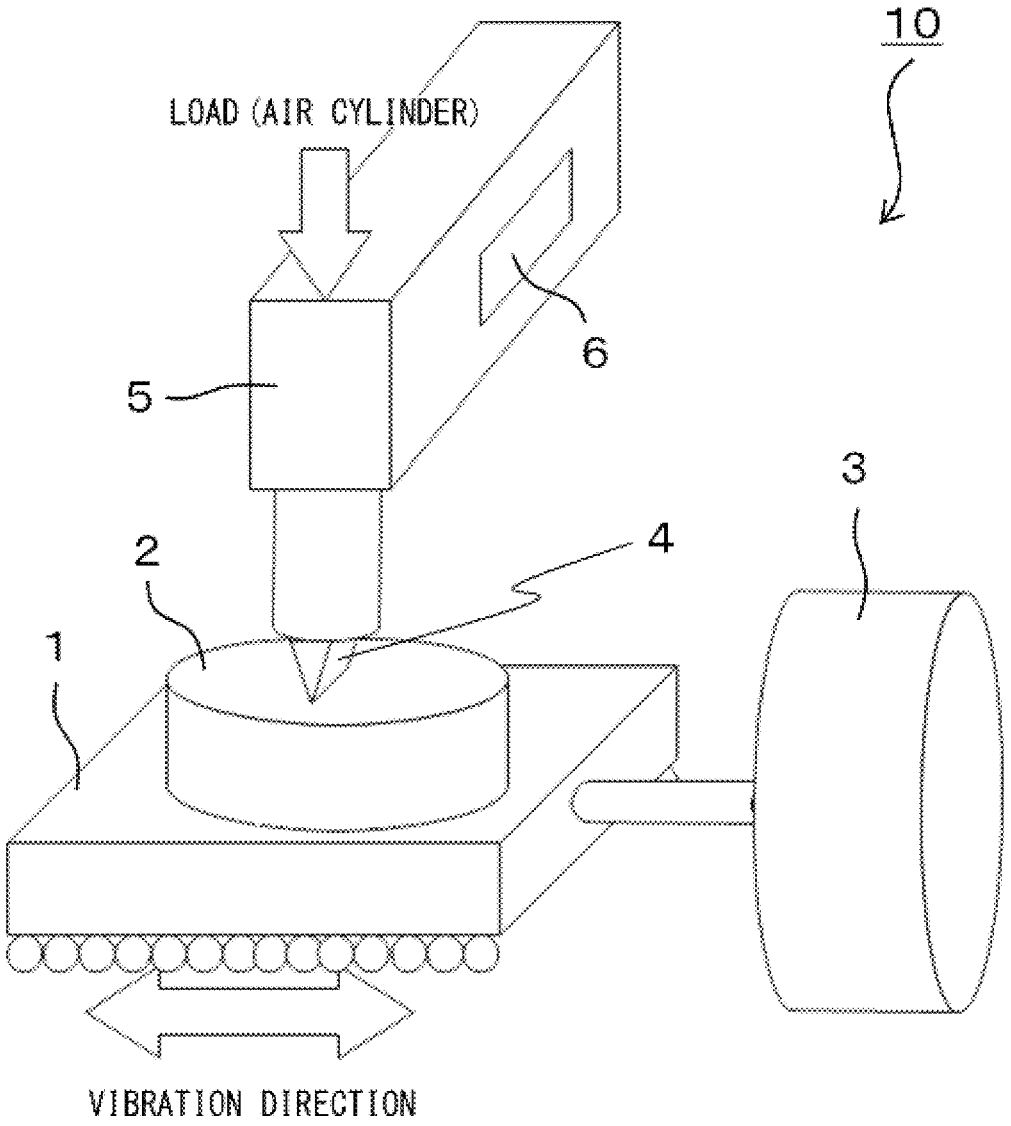
FIG. 5 is a view illustrating an example of a friction testing device according to this embodiment.

Using a friction testing device 10 illustrated in FIG. 5, a pin test piece 4 and a disk test piece 2 were reciprocated at an amplitude of ±0.2 mm, a frequency of 1.5 Hz, 20 N, and 30° C., and then the average friction coefficient was measured.

In the friction test 1, shock absorber lubricating oil to which various friction adjusting agents of a phosphorus type, an amine type, an ester type, or the like were added were measured for the friction coefficient when 1% of ZnDTP was added and when no ZnDTP was added. FIG. 1 illustrates the friction coefficients of the shock absorber lubricating oil to which no ZnDTP was added. FIG. 2 illustrates the friction coefficients of the shock absorber lubricating oil to which ZnDTP was added. When the friction coefficient of the shock absorber lubricating oil is excessively small, the driving stability deteriorates. When the friction coefficient of the shock absorber lubricating oil is excessively large, the riding comfort deteriorates. Therefore, the friction coefficient is preferably adjusted in the range of 0.02 to 0.05. Conventionally, the friction coefficient has been adjusted by adjusting the addition amount of the friction adjusting agent. However, when no ZnDTP was added as illustrated in FIG. 1, it has been difficult to adjust the friction coefficient with the friction adjusting agent alone. In contrast, when ZnDTP was added as illustrated in FIG. 2, it became easy to adjust the friction coefficient according to the addition amount of the friction adjusting agent, and thus the friction coefficient was able to be adjusted in the range of 0.02 to 0.05.

In the shock absorber lubricating oil containing the ZnDTP of Formula 1, when the ZnDTP addition amount was 0.1 to 4.0 wt. %, a maximum friction coefficient/average friction coefficient value was 1.3 or less, and when the ZnDTP addition amount was 0.25 to 2.0 wt. %, a maximum friction coefficient/average friction coefficient value further decreased to less than 1.22. When the maximum friction coefficient/average friction coefficient value is closer to 1, a variation in the friction coefficient is small, and thus it can be evaluated that the riding comfort is good. This has proved that, in the shock absorber lubricating oil containing ZnDTP having a primary alkyl group and a secondary alkyl group according to the present invention, the riding comfort is improved by setting the ZnDTP addition amount to 0.25 to 2.0 wt. %.

[Friction Test 2] Effect of ZnDTP Structure

Using the friction testing device 10 illustrated in FIG. 5, the pin test piece 4 and the disk test piece 2 were reciprocated at an amplitude of ±0.1 mm, a frequency of 5 Hz, 20 N, and 30° C.

Figure 11:
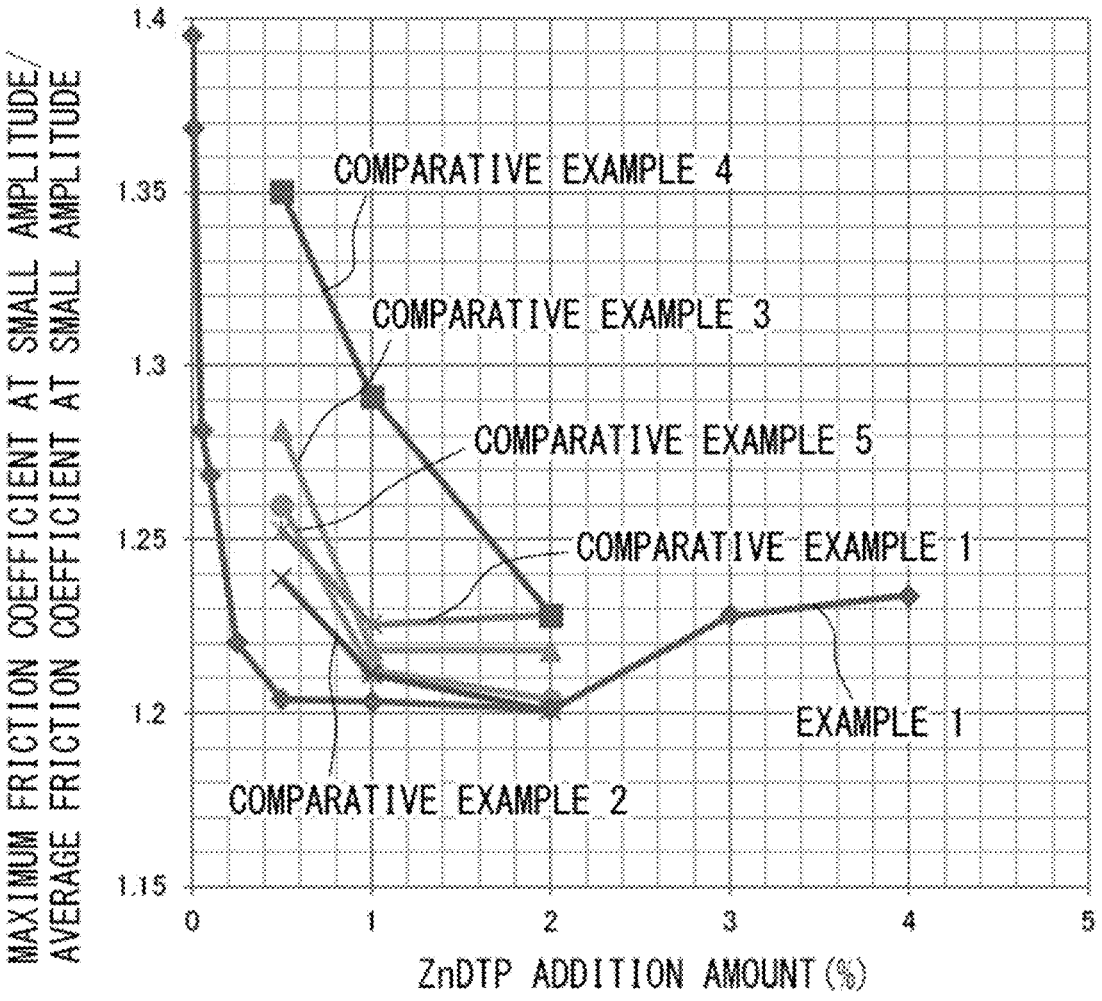
FIG. 11 is a graph illustrating the friction characteristics of each shock absorber lubricating oil according to the type of ZnDTP.

As illustrated in FIG. 11, the friction coefficient was also measured for not only Example 1 which is the shock absorber lubricating oil according to the present invention (i.e., shock absorber lubricating oil containing ZnDTP having a primary alkyl group and a secondary alkyl group) but Comparative Examples 1 to 4.

Example 1: shock absorber lubricating oil containing ZnDTP having a primary alkyl group and a secondary alkyl group.

Comparative Example 1: Example of a shock absorber lubricating oil to which ZnDTP having only a primary alkyl group having 3, 5 carbon atoms was added.

Comparative Example 2: Example of a shock absorber lubricating oil to which ZnDTP having only a secondary alkyl group having 3, 5 carbon atoms was added.

Comparative Example 3: Example of a shock absorber lubricating oil to which ZnDTP having only a secondary alkyl group having 6, 8 carbon atoms was added.

Comparative Example 4: Example of a shock absorber lubricating oil to which ZnDTP having only a primary alkyl group having 8 carbon atoms was added.

Comparative Example 5: Example of a shock absorber lubricating oil to which a 1:1 mixture of ZnDTP having only a secondary alkyl group having 3, 6 carbon atoms and ZnDTP having only a primary alkyl group having 8 carbon atoms was added.

The friction test 2 showed that, in Comparative Examples 1 to 5, the maximum friction coefficient/average friction coefficient values were likely to fluctuate when the ZnDTP addition amount changed as compared with Example 1, whereas, in Example 1, the maximum friction coefficient/average friction coefficient value was less likely to fluctuate even when the ZnDTP addition amount changed. For example, in Example 1, the maximum friction coefficient/average friction coefficient value remained 1.24 or less when the ZnDTP addition amount was in the range of 0.2 to 4.0 wt. %. This has showed that, in the shock absorber lubricating oil containing the ZnDTP having a primary alkyl group and a secondary alkyl group according to Example 1, even when the ZnDTP deterioration (decomposition) progressed due to long-term use, so that the ZnDTP content decreased, an effect that the riding comfort is less likely to change is higher than the effect in Comparative Examples 1 to 5.

(B2) Pentaerythritol

Pentaerythritol is a tetravalent sugar alcohol, and it is known that polyols are used to form oil-soluble or oil-dispersible polymer friction adjusting agents. The pentaerythritol according to the present invention is preferably used in the form of an ester. Pentaerythritol includes pentaerythritol tetraester in which all four terminal substituents are ester-bonded to fatty acid residues and pentaerythritol monoesters, pentaerythritol diesters, and pentaerythritol triesters which are partial esters in which any terminal substituent is ester-bonded to a fatty acid residue. The type of the pentaerythritol is not particularly limited in the present invention.

The present inventors have also further studied on a pentaerythritol component to provide a shock absorber lubricating oil capable of achieving both driving stability and riding comfort at a small amplitude. The present inventors have found that the friction coefficient of a shock absorber lubricating oil can be adjusted by adjusting the number of carbon atoms of a fatty acid residue of pentaerythritol ester, and have already filed a patent application (JP 2019-187393 A). The contribution of the pentaerythritol in terms of the function of the shock absorber lubricating oil in the present invention is as follows: (1) the friction coefficient can be easily adjusted to be suitable for ride comfort and driving stability when ZnDTP, which has been conventionally used, is added, and when pentaerythritol is further added as a friction adjusting agent, a difference between the friction coefficient in a transition from a stationary state to a moving state or at a small amplitude and the friction coefficient in a moving state or at a normal amplitude can be reduced, and riding comfort can be improved, (2) a shock absorber lubricating oil and an additive for friction adjustment of a shock absorber capable of sustainably achieving both riding comfort and driving stability over a long period of time can be provided due to the deterioration (decomposition) of ZnDTP can be suppressed by the pentaerythritol, and (3) by using pentaerythritol, the adjustment of the friction coefficient of the shock absorber lubricating oil can be achieved.

More specifically, the pentaerythritol of the present invention can be combined with the ZnDTP to form the friction adjusting agent for adjusting the friction coefficient of the shock absorber lubricating oil in the range of 0.02 to 0.05. More specifically, the following pentaerythritol can be exemplified as a preferable specific example.

When the number of carbon atoms of the fatty acid residue of pentaerythritol ester is larger, the friction coefficient of the shock absorber lubricating oil tends to be smaller. When the number of carbon atoms of the fatty acid residue is smaller, the friction coefficient of the shock absorber lubricating oil tends to be larger. Therefore, the pentaerythritol ester can be selected focusing on the number of carbon atoms of the fatty acid residue contained in the pentaerythritol ester such that the friction coefficient of the shock absorber lubricating oil becomes a desired friction coefficient. The friction coefficient of the shock absorber lubricating oil can also be adjusted by combining a plurality of pentaerythritol esters having fatty acid residues different in the number of carbon atoms. For example, the friction coefficient of the shock absorber lubricating oil can also be adjusted by adjusting the blending amount of pentaerythritol ester having a fatty acid residue with a small number of carbon atoms and pentaerythritol tetraester having a fatty acid residue with a large number of carbon atoms.

The fatty acid residues are not particularly limited, and can be, for example, C6 to C22 fatty acid residues, such as a stearic acid residue or an oleic acid residue. Further, as the fatty acid residues, caprylic acid, capric acid, oleic acid, stearic acid, myristic acid, palmitic acid, linoleic acid, adipic acid, pelargonic acid, tall fatty acid, palm fatty acid, coconut fatty acid, and tallow acid can be exemplified.

The pentaerythritol ester is preferably mainly pentaerythritol tetraester. More specifically, among pentaerythritol monoesters, diesters, triesters, and tetraesters, those having the largest proportion of tetraesters or those containing 50% or more of tetraesters are preferable.

Effects of blending the pentaerythritol in the friction adjusting agent are described.

(Relationship Between Pentaerythritol Addition Amount and Friction Coefficient)

Figure 3:
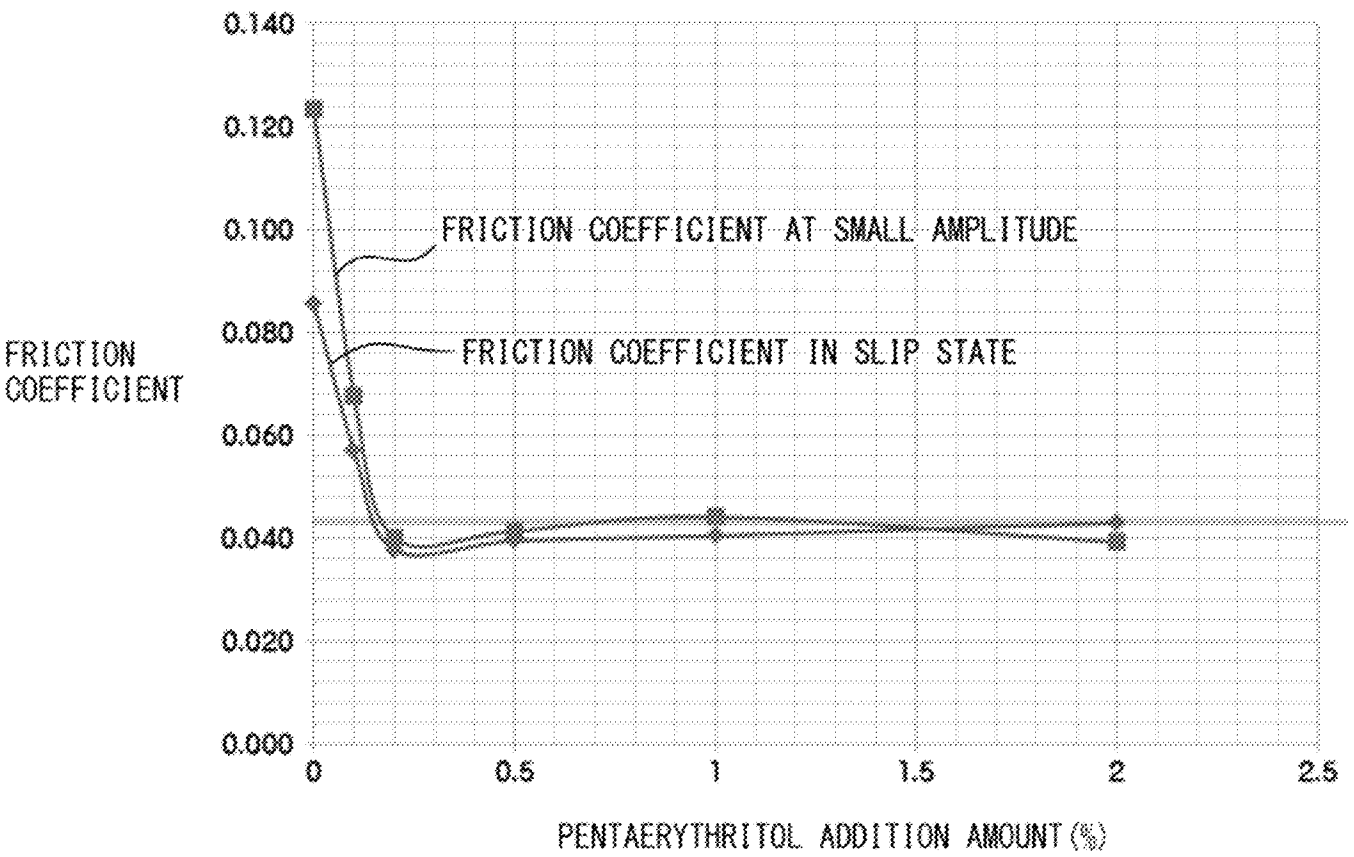
FIG. 3 is a view for explaining the relationship between the friction coefficient of a shock absorber lubricating oil to which ZnDTP is added and the pentaerythritol addition amount.

FIG. 3 is a graph illustrating the relationship between the friction coefficient of the shock absorber lubricating oil to which ZnDTP is added and the pentaerythritol addition amount. As illustrated in FIG. 3, when the pentaerythritol addition amount is 0.2 wt. % or more, the friction coefficient of the shock absorber lubricating oil to which ZnDTP is added does not fluctuate and falls in the range of 0.02 to 0.05. As described above, when the pentaerythritol addition amount is 0.2 wt. % or more, the friction coefficient of the shock absorber lubricating oil is not affected. Therefore, in this embodiment, the pentaerythritol is contained in a proportion of 0.2 wt. % or more and more preferably 1 wt. % or more. In addition, the pentaerythritol can be contained in a proportion of more than 3 wt. % or more, or the pentaerythritol can be contained in a proportion of 5 wt. % or more.

EXAMPLES (Friction Adjustment Characteristics of ZnDTP)

First, the amplitude dependent index was calculated for three shock absorber lubricating oils of (a) ZnDTP and pentaerythritol-free base oil (shock absorber lubricating oil), (b) a shock absorber lubricating oil in which ZnDTP mainly having a long chain (8 to 12 carbon atoms) primary alkyl group was added to the base oil (a), and (c) a shock absorber lubricating oil in which ZnDTP mainly having a short chain (3 to 5 carbon atoms) secondary alkyl group was added to the base oil (a).

Herein, the amplitude dependent index serves as a guide for evaluating the riding comfort newly adopted in the present invention and is the index indicated by "Friction coefficient at small amplitude/Friction coefficient at normal amplitude" at the same frequency and calculated from the results of a friction test described below. The "Friction coefficient at small amplitude" is a friction coefficient at an amplitude of ±1.0 mm or less. The "Friction coefficient at normal amplitude" is a friction coefficient at an amplitude of larger than ±1.0 mm. However, when both the small amplitude and the normal amplitude are made closer to ±1.0 mm, a value of the amplitude dependent index is close to 1, which makes it impossible to properly evaluate the friction characteristics of the shock absorber lubricating oil in some cases. Therefore, the "Friction coefficient at small amplitude" is preferably a friction coefficient at an amplitude of ±0.2 mm or less and the "Friction coefficient at normal amplitude" is preferably a friction coefficient at an amplitude of ±2.0 mm or more. The "Friction coefficient at small amplitude" and the "Friction coefficient at normal amplitude" may be the average value or the maximum value of the friction coefficients within a predetermined period of time. When the amplitude dependent index has a value closer to 1, a difference between the friction coefficient at a small amplitude and the friction coefficient at a normal amplitude is small, and thus it can be evaluated that the riding comfort is good. The amplitude dependent index is preferably in the range of 0.3 to 3.0 and more preferably in the range of 0.5 to 2.0.

[Measurement of Friction Coefficient]

Figure 4:
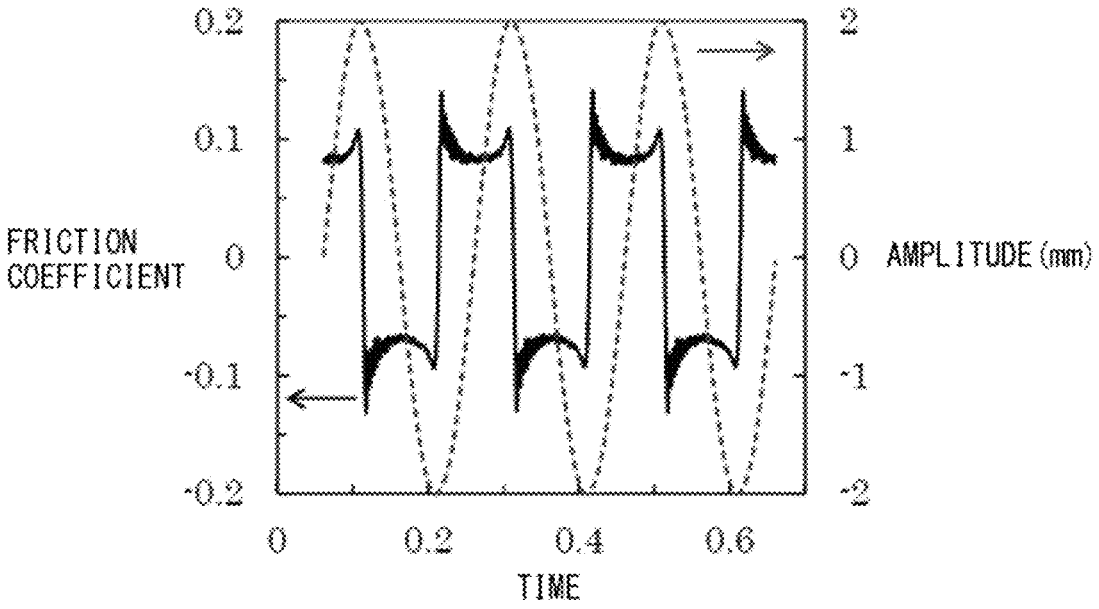
FIG. 4 is a conventional graph illustrating the fluctuation of the friction coefficient of a shock absorber lubricating oil in a friction test.

Conventionally, with respect to the frictional force of the shock absorber lubricating oil, static friction and dynamic friction are repeated in the reciprocating motion of a shock absorber as illustrated in FIG. 4, and therefore the average value of the friction coefficients at the moment of the transition from the static friction to the dynamic friction was calculated as the friction coefficient of the shock absorber lubricating oil in conventional friction test results. In FIG. 4, the solid line represents the friction coefficient and the broken line illustrates the fluctuation amount between a pin test piece and a disk test piece. In contrast, in the present invention, the friction testing device 10 illustrated in FIG. 5 was manufactured, and the friction coefficient was measured using the friction testing device 10 as described below.

[Friction Testing Device 10]

The friction testing device 10 illustrated in FIG. 5 is a pin-on-disk type friction testing device and measures the frictional force, which is generated by reciprocating the disk test piece 2 fixed onto a slide bearing 1 by an electromagnetic shaker 3 and sliding the pin test piece 4 while pressed against the disk test piece 2, using a strain gauge 6 attached to a fixed shaft 5 of the pin test piece 4. As a factor affecting the friction characteristics of a shock absorber, a combination of a shock absorber lubricating oil and an oil seal is mentioned. Therefore, in the friction testing device 10 illustrated in FIG. 5, acrylonitrile-butadiene rubber (NBR) used as an oil seal in a shock absorber was used for the pin test piece 4, and the tip of the pin test piece 4 was cut to have an angle of 140° to imitate the oil lip shape. For the disk test piece 2, a hard chrome-plated film used for the surface of a piston rod was used and the surface roughness was set to Ra 0.01 μm or less by applying abrasive finishing. Although this embodiment measures the frictional force (friction coefficient) between the NBR pin test piece 4 and the chrome-plated disk test piece 2, the frictional force (friction coefficient) between a copper ball and the chrome-plated disk test piece 2 may be measured.

[Friction Test 3]

In a friction test 3 using the friction testing device 10 illustrated in FIG. 5, the amplitudes were set to ±0.1 mm, ±0.2 mm, ±0.5 mm, ±1.0 mm, and ±2.0 mm, and the reciprocation was performed at a frequency of 50 Hz at each amplitude. This means that the friction test is performed at different velocities.

[Results of Friction Test 3]

Figures 6A, 6B, 6C:
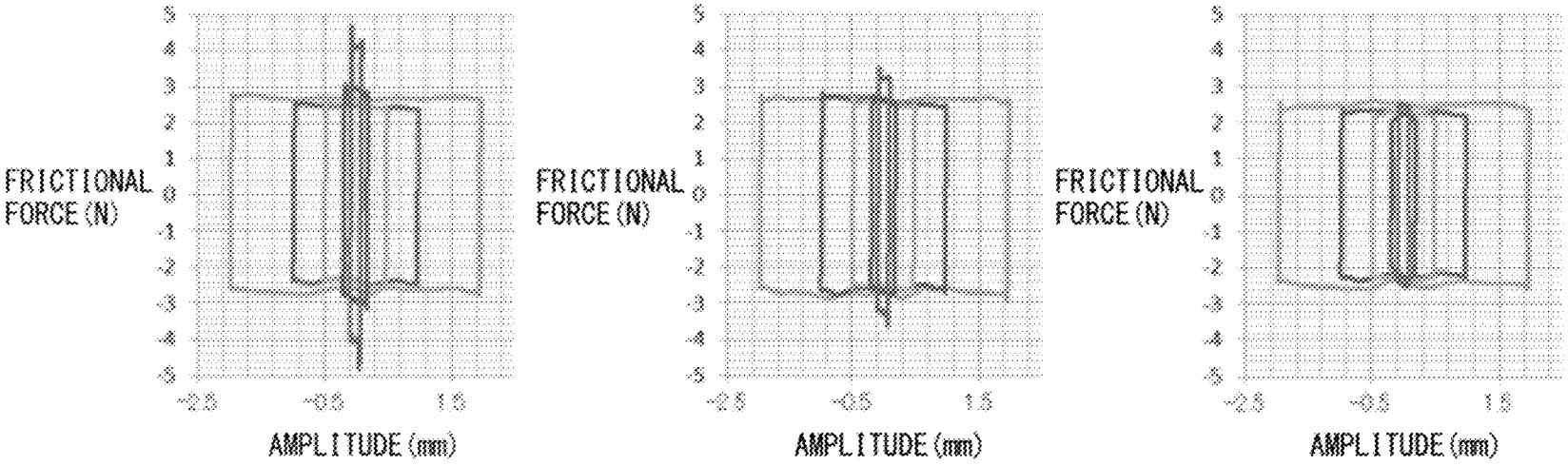
FIGS. 6(*a*) to 6(*c*) are views illustrating an example of test results of the friction testing device according to this embodiment.

FIG. 6 illustrates the results of the friction test 3 according to this example. The results of the friction test illustrated in FIG. 6 are obtained by measuring the frictional force (friction coefficient) between the copper ball and the chrome-plated disk test piece 2.

In the shock absorber lubricating oil (a) to which no ZnDTP was added, the friction coefficients at small amplitudes (low velocity) of ±0.1 mm, ±0.2 mm, and the like are higher than the friction coefficients at normal amplitudes (high velocity) of ±1.0 mm, ±2.0 mm, and the like.

In contrast, the shock absorber lubricating oil (b) to which ZnDTP having a long chain (8 to 12 carbon atoms) primary alkyl group was added, a difference between the friction coefficients at small amplitudes (low velocity) and the friction coefficients at normal amplitudes (high velocity) is smaller than that in the shock absorber lubricating oil (a).

In the shock absorber lubricating oil (c) to which ZnDTP having a short chain (3 to 5 carbon atoms) secondary alkyl group was added, a difference between the friction coefficients at small amplitudes (low velocity) and the friction coefficients at normal amplitudes (high velocity) is much smaller than those in the shock absorber lubricating oil (a) and (b).

[Effect of Improving Riding Comfort by ZnDTP]

Figure 7:
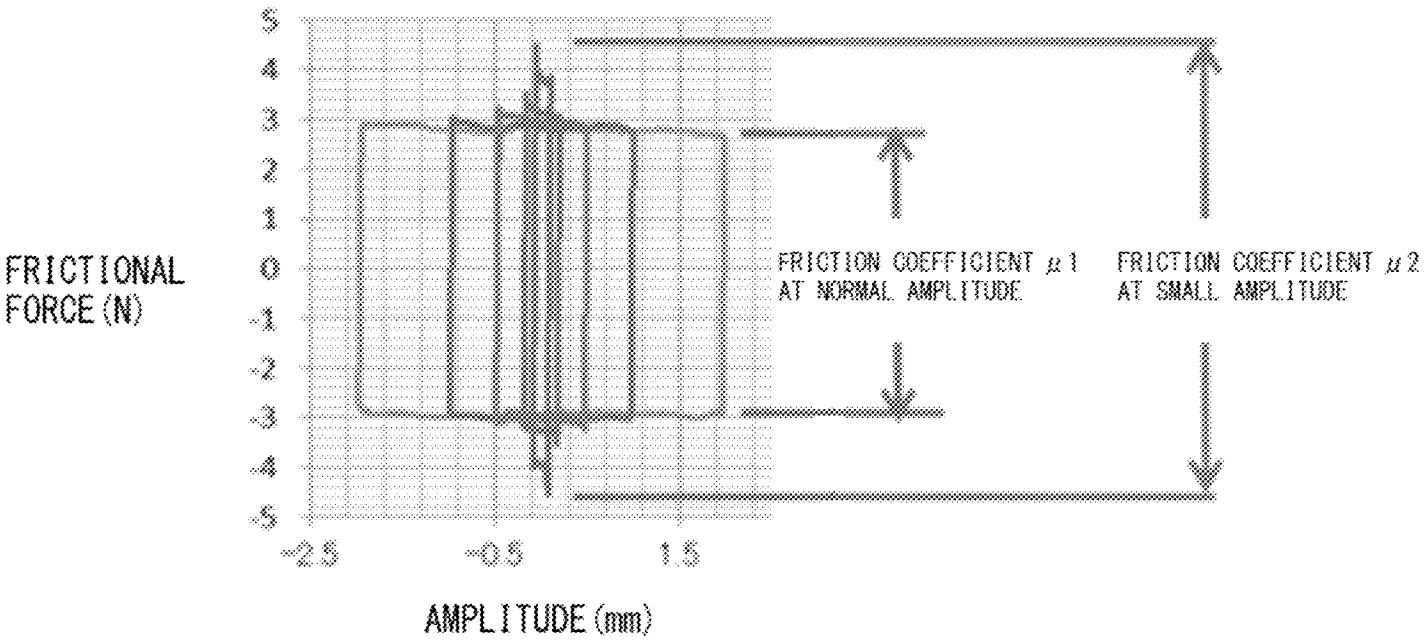
FIG. 7 is a diagram for explaining the amplitude dependent index.

In order to digitize the characteristics illustrated by the results of the friction test 3 above, the "Friction coefficient at small amplitude/"Friction coefficient at normal amplitude" at the same frequency (50 Hz in the examples illustrated in FIGS. 5 to 7) was specified as the amplitude dependent index as illustrated in FIG. 7. Specifically, in the example illustrated in FIG. 7, the "Friction coefficient at small amplitude of ±0.1 mm/Friction coefficient at normal amplitude of ±2.0 mm" was specified as the amplitude dependent index. When the amplitude dependent index is closer to 1, the fluctuation of the friction coefficient according to the velocity is small. Thus, the amplitude dependent index serves as an index, by which it can be judged that the riding comfort is correspondingly high. In the graph illustrated in FIG. 7, the vertical axis represents the frictional force. In determining the amplitude dependent index, the "Frictional force at small amplitude/Frictional force at normal amplitude" obtained in the test results may also be calculated as the amplitude dependent index when the friction test is performed at the same load (N). More specifically, in the present invention, the calculation of the "Friction coefficient at small amplitude/Friction coefficient at normal amplitude" as the amplitude dependent index includes measuring the frictional force at a small amplitude and the frictional force at a normal amplitude at the same load, and then calculating the measured "Frictional force at small amplitude/Frictional force at normal amplitude" as the amplitude dependent index.

Figure 8:
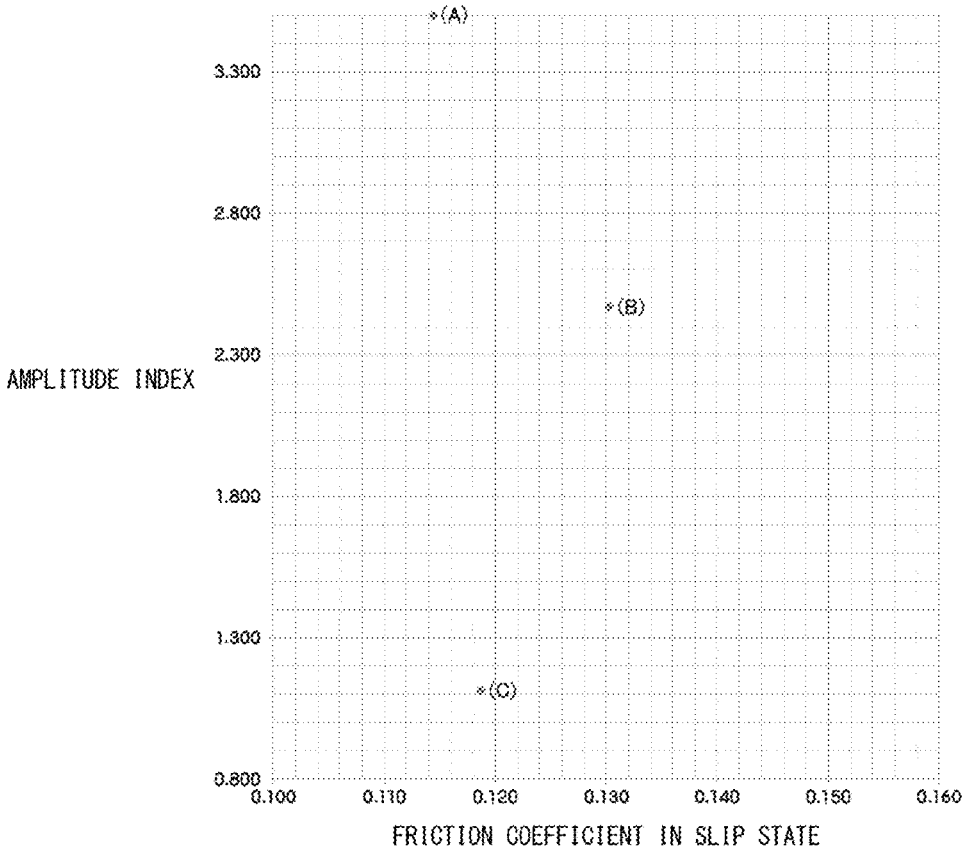
FIG. 8 is an example of the amplitude dependent index of a shock absorber lubricating oil.

FIG. 8 illustrates the amplitude indices of the shock absorber lubricating oil (a) to (c) above.

As illustrated in FIG. 8, the amplitude dependent index of the shock absorber lubricating oil (a) is 3.5, which is a value farthest from 1, the amplitude dependent index of the shock absorber lubricating oil (b) is 2.48, which is the second closest value to 1, and the amplitude dependent index of the shock absorber lubricating oil (c) is 1.1, which is the closest value to 1.

This shows that the amplitude dependent index of the shock absorber lubricating oil to which ZnDTP was added is closer to 1 than that of the shock absorber lubricating oil to which no ZnDTP was added, and the riding comfort is improved. Further, it has been found that, even when ZnDTP was similarly added, the amplitude dependent index of the shock absorber lubricating oil to which ZnDTP having a short chain (3 to 5 carbon atoms) secondary alkyl group was added has a value closer to 1 than that of the shock absorber lubricating oil to which ZnDTP having a long chain (8 to 12 carbon atoms) primary alkyl group was added, and the riding comfort is improved.

(Effect of Suppressing ZnDTP Deterioration by Pentaerythritol)

A further study was carried out, and then it has been found that, when ZnDTP having a short chain (3 to 5 carbon atoms) secondary alkyl group was added to the shock absorber lubricating oil, the ZnDTP deteriorated (decomposed), and thus the friction coefficient of the shock absorber lubricating oil decreased. Then, the present inventors have tried various additives to suppress such a ZnDTP deterioration (decomposition), and then have reached the present invention capable of suppressing the ZnDTP deterioration (decomposition) by adding pentaerythritol.

Figure 9:
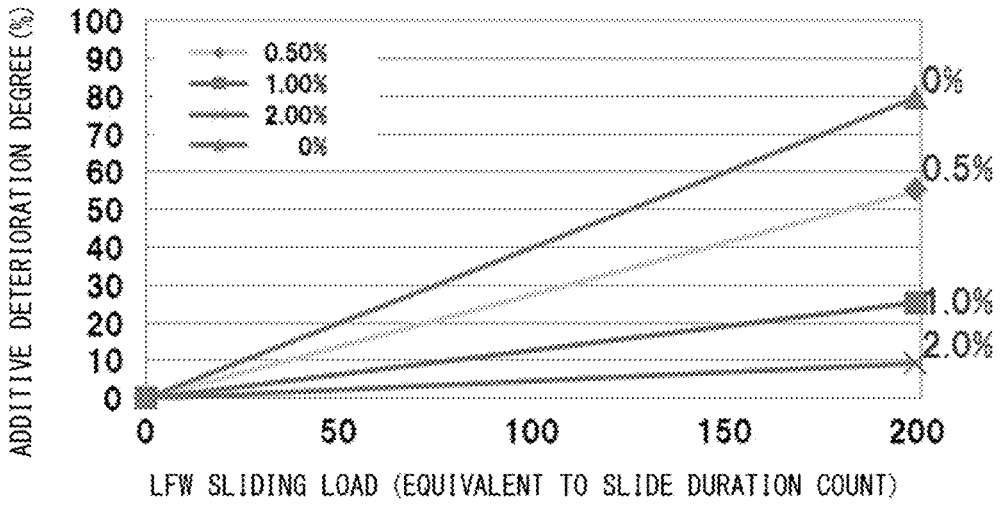
FIG. 9 is a view for explaining the relationship between the ZnDTP deterioration degree and the pentaerythritol addition amount.

Herein, FIG. 9 is a graph illustrating the relationship between the ZnDTP deterioration (decomposition) degree and the pentaerythritol addition amount. In Example illustrated in FIG. 9, a FALEX-LFW1 testing device, which is a block-on-ring type friction testing device, was used, 250 ml of a lubricating oil additive was added to a sliding portion, the sliding portion was slid at a velocity of 0.6 m/s and a load of 6581 N, sludge was removed with a centrifuge, and then the ZnDTP content was measured using FT-IR. As illustrated in FIG. 9, it was found that, when no pentaerythritol was added, the ZnDTP deteriorated (decomposed) by about 80% when the shock absorber was operated about 2 million times. In contrast, when pentaerythritol was added in a proportion of 0.5 wt. %, the ZnDTP deterioration was suppressed to about 55% when the shock absorber was operated about 2 million times. When 1.0 wt. % of pentaerythritol was added, the ZnDTP deterioration was suppressed to about 25% when the shock absorber was operated about 2 million times. When 2.0 wt. % of pentaerythritol was added, the ZnDTP deterioration was suppressed to about 9% when the shock absorber was operated about 2 million times.

[Consideration]

Figure 10A:
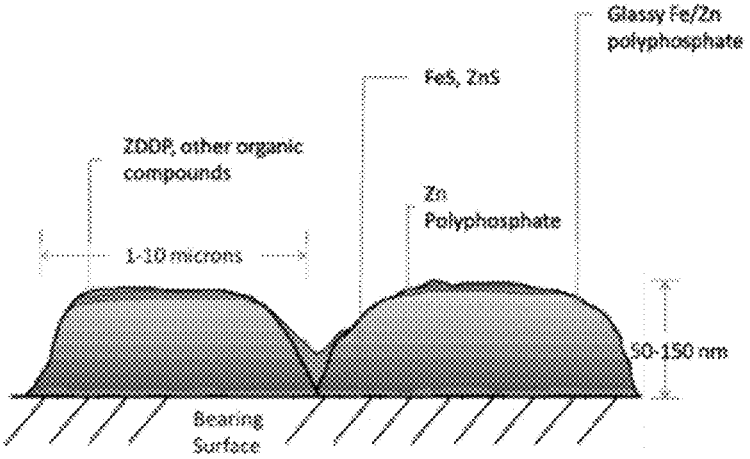
FIGS. 10(A) to 10(C) are views for explaining actions of ZnDTP and pentaerythritol in a shock absorber lubricating oil according to this embodiment.
Figure 10B:
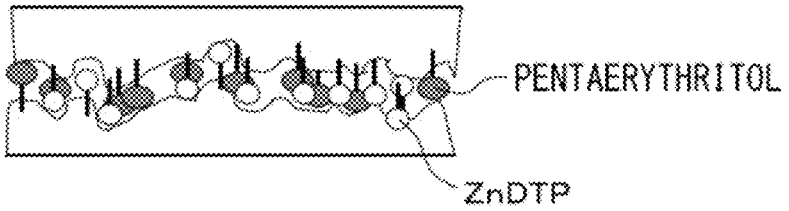
Figure 10C:
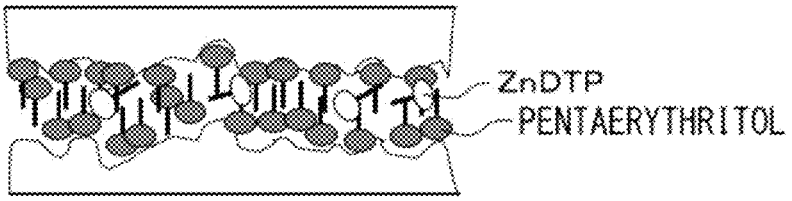

FIG. 10(A) is a view for explaining the shock absorber lubricating oil to which ZnDTP was added. As illustrated in FIG. 10(A), it is known that, in the shock absorber lubricating oil to which ZnDTP was added, the surface film of the ZnDTP is formed thicker than that of other additives. It is considered that a reaction film of the ZnDTP is likely to be formed due to an increase in the oil temperature caused by the friction in boundary lubrication at the transition from a stationary state to a moving state or at a small amplitude. Therefore, it is considered that the ZnDTP acts on the boundary surface to suppress the frictional force in the boundary lubrication at the transition from a stationary state to a moving state or at a small amplitude as illustrated in FIG. 10(B). In contrast, in a moving state or at a normal amplitude, a reaction film of the pentaerythritol is formed on the surface of the shock absorber lubricating oil as illustrated in FIG. 10(C), so that the ZnDTP deterioration (decomposition) can be suppressed.

As described above, the shock absorber lubricating oil according to this embodiment contains (A) the base oil and (B) the friction adjusting agent, in which (B) the friction adjusting agent contains (B1) the zinc dithiophosphate (ZnDTP) and (B2) the pentaerythritol. In particular, since the shock absorber lubricating oil according to this embodiment contains (B1) the ZnDTP, the friction coefficient can be easily adjusted to 0.02 to 0.05 at which both the driving stability and the riding comfort can be achieved by changing the addition amount of the friction adjusting agent. If no ZnDTP is added, the friction coefficient immediately deviates from the target friction coefficient when the addition amount of the friction adjusting agent has just slightly changed by deterioration of the friction adjusting agent. However, the addition of the ZnDTP can effectively suppress the immediate deviation of the friction coefficient from the target friction coefficient even when the friction adjusting agent has deteriorated (decomposed), so that the addition amount of the friction adjusting agent has changed.

Further, since the shock absorber lubricating oil according to this embodiment contains (B1) the ZnDTP, a thick surface film is formed by the ZnDTP even in the boundary lubrication (the boundary lubrication is a state in which a lubricating film of sufficient thickness cannot be formed between the two surfaces of the friction portion, and thus the friction surfaces are partially brought into solid contact with each other). Therefore, even in the boundary lubrication, a friction coefficient similar to that in mixed lubrication or fluid lubrication can be obtained, and thus the riding comfort can be improved. Further, since the shock absorber lubricating oil according to this embodiment contains (B2) the pentaerythritol, a surface film of the pentaerythritol is formed in a moving state or at a normal amplitude, and thus the deterioration of the ZnDTP can be effectively prevented. Particularly in this embodiment, when the pentaerythritol addition amount is set to 0.2 wt. % or more, the friction coefficient hardly changes regardless of the pentaerythritol addition amount, and thus the ZnDTP deterioration (decomposition) can be suppressed over a longer period of time by increasing the pentaerythritol addition amount. Thus, even when the amplitude of the shock absorber changes, the shock absorber lubricating oil according to this embodiment can maintain the riding comfort over a long time regardless of the change in the amplitude.

Although the preferable embodiments of the present invention are described above, the technical scope of the present invention is not limited to the description of the above embodiments. The above-described embodiments can be variously altered/modified and such altered/modified embodiments are also included in the technical scope of the present invention.

The invention claimed is:

1. A shock absorber including a lubricating oil composition, the lubricating oil composition comprising:

a base oil; and a friction adjusting agent, wherein the friction adjusting agent contains zinc dithiophosphate and pentaerythritol esters and/or pentaerythritol derivatives, the zinc dithiophosphate has at least one secondary alkyl group having 3 to 5 carbon atoms, wherein the pentaerythritol esters and/or pentaerythritol derivatives are contained in 2 to 5 wt. % based on total amount of the lubricating oil composition, the pentaerythritol esters and/or pentaerythritol derivatives contain pentaerythritol tetraester and/or pentaerythritol tetraester derivative, and all four terminal substituents of the pentaerythritol tetraester and/or pentaerythritol tetraester derivative are ester-bonded oleic acid residues.

2. The shock absorber according to claim 1, wherein the zinc dithiophosphate is contained in an amount of 0.1 wt. % or more and 4.0 wt. % or less in the lubricating oil composition.

3. The shock absorber according to claim 1, wherein the zinc dithiophosphate is primary zinc dithiophosphate represented by Formula 1 below,

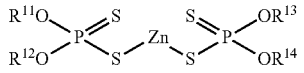

(1)

wherein, in Formula 1, $R^{11}$ to $R^{14}$ are alkyl groups, and the alkyl groups have a primary alkyl group and a secondary alkyl group, and one or more and three or less Rs of $R^{11}$ to $R^{14}$ are primary alkyl groups and the rest of $R^{11}$ to $R^{14}$ are secondary alkyl groups.

4. The shock absorber according to claim 2, wherein the friction adjusting agent is configured so as to adjust an amplitude dependent index in a range of 0.3 to 3.0 in addition to the friction coefficient of the composition.

5. The shock absorber according to claim 1, wherein the zinc dithiophosphate is a mixture of primary zinc dithiophosphate and secondary zinc dithiophosphate different from the primary zinc dithiophosphate.

* * * * *